United States Patent [19]

Dammann et al.

[11] 4,301,578

[45] Nov. 24, 1981

[54] PROCESS AND APPARATUS FOR TEXTURING THREAD

[75] Inventors: Peter Dammann; Hans-Peter Berger; Wilfried Mündelein, all of Remscheid; Manfred Bussmann, Hückeswagen; Horst Beifuss, Wermelskirchen-Tente, all of Fed. Rep. of Germany

[73] Assignee: Barmag Barmer Maschinenfabrik AG, Remscheid-Lennep, Fed. Rep. of Germany

[21] Appl. No.: 17,251

[22] Filed: Mar. 5, 1979

[30] Foreign Application Priority Data

Mar. 3, 1978 [DE] Fed. Rep. of Germany ..... 2809204

[51] Int. Cl.[3] ..... D02G 1/12; D02G 1/20

[52] U.S. Cl. ..... 28/256; 28/266

[58] Field of Search ..... 28/250, 256, 262, 263, 28/264, 266, 267, 278, 281; 242/47.01

[56] References Cited

U.S. PATENT DOCUMENTS 2,321,757 6/1943 Lodge ..... 28/278
3,217,482 11/1965 Baer ..... 28/264 X
3,296,680 1/1967 Iwnicki et al. ..... 28/250
3,311,961 4/1967 Iwnicki et al. ..... 28/250
4,118,843 10/1978 Schippers et al. ..... 28/266 X

FOREIGN PATENT DOCUMENTS 1085057 9/1967 United Kingdom ..... 28/278

*Primary Examiner*—Robert Mackey
*Attorney, Agent, or Firm*—John H. Shurtleff

[57] ABSTRACT

In the stuffing of synthetic continuous filamentary threads in stuffer boxes, special value is to be placed on the thermal treatment and especially the cooling of the initially crimped filaments. The filaments in the configuration of a compact thread plug, which is formed in the stuffer box, can be wound on a rotatably driven drum in several helical windings, the last thread plug winding can then be disentangled again at the end of the drum, and the finished texturized thread drawn off. The disentangling of the thread plug and the drawing off of the thread is improved by the present invention through an application of axial and/or radial forces or pressures onto the last thread plug winding in the region of the disentangling point. Suitable mechanical and pneumatic devices are provided by the invention for this purpose.

27 Claims, 6 Drawing Figures

PROCESS AND APPARATUS FOR TEXTURING THREAD

BACKGROUND OF THE INVENTION

The invention relates to a process for thermal treatment, especially a cooling, of at least one continuously running thread plug, as formed from synthetic filaments, e.g. polyamide, polyester or polyolefin filaments, in a stuffer crimping box. The thread plug is conducted over an air-permeable surface during the thermal treatment, and is then disentangled to draw off the crimped and thermally treated thread. The invention also relates to useful and improved apparatus for carrying out the process.

Such apparatus for the thermal treatment of the stuffer box thread plug preferably consists of a rotationally driven, air-permeable drum onto which one or more thread plugs are conducted and wound or coiled into a closed layer of several thread plug windings extending in helical lines around the circumference of the drum and being axially advanced by an advancing device at the entry or rear end of the drum where axial pressure is applied to the first winding. This apparatus has been proposed in U.S. Pat. No. 4,118,843 for the purpose of carrying out a special continuously operated spin-stretch texturizing process with a continuous stuffer box crimping followed by a thermal gas treatment of the continuous thread plug.

The thread plug windings which are helically coiled or wound onto the substantially cylindrical treatment drum are taken off at the exit or front end of the drum after the thermal treatment is completed, in particular, after fixing of the crimp in the filaments and usually cooling of the thread material with a gas or vapor during a sufficient residence time on the drum. The thread is thus disentangled and removed by a draw-off spooling or winding arrangement driven at a selected speed with an adjustable thread tension. In this operation, the thread plug may be slightly opened or loosened in its consistency as it is applied onto the drum in order to improve its gas-permeability on the drum. However, after the thermal treatment, the thread plug is disentangled near the exit end of the drum, and a texturized thread is drawn off at a speed which is less than the circumferential speed of the preceding stretch godets, but very much higher than the circumferential speed of the treatment drum.

Because the present invention represents a specific improvement in the process and apparatus of U.S. Pat. No. 4,118,843, being readily adapted to the embodiments and variations of treating a stuffer crimped thread plug as taught therein, this earlier and commonly assigned patent is incorporated herein by reference as fully as if set forth in its entirety.

SUMMARY OF THE INVENTION

It is an object of the present invention to recover the texturized thread material after it has been conducted on a thermal treatment drum as a closed layer of helically wound thread-plug windings lying closely adjacent one another, using an improved process and apparatus to disentangle and separate the thread at the exit end of the drum in a manner which is relatively simple, operationally safe and without damage to individual filaments of the continuous thread-plug winding. It is a further object of the invention to provide a disentangling of the thread plug during its emergence and draw-off from the thermal treatment zone wherein the point or zone of disentanglement is stabilized and made uniform and better reproducible with any given thread material. It has now been recognized in the earlier process of U.S. Pat. No. 4,118,843 that under certain conditions of thread draw-off from the thread plug, the thread plug winding can be contacted and damaged, thereby causing disturbances in operation, especially at the point or zone of thread disentanglement. A specific object of the invention is therefore a procedure and apparatus for avoiding serious problems of thread disentanglement and draw-off from the treatment drum.

Other objects and advantages of the invention are explained in greater detail in the description which follows.

In accordance with the present invention, an improvement is achieved in combination with steps in a process for the thermal treatment of at least one continuously running thread plug, as formed from a thread of synthetic filaments in a stuffer crimping box, wherein the thread plug is circumferentially conducted and wound into a closed layer of a plurality of helically coiled windings on a rotationally driven, air-permeable treatment drum, this thread plug also being axially advanced by a device applying pressure in the axial direction to a first winding at the entry end of said drum, and the thread is withdrawn after thermal treatment on the drum at a disentangling point near its exit end, by the steps of applying (1) an axially advancing pressure and/or (2) an increased radial contact pressure onto at least a portion of the last thread plug winding running into the disentangling point and also onto the thread emerging from said disentangling point, thereby separating said last thread plug winding from the next to last thread plug winding.

Both of the designated measures in each case are individually effective, but when used in combination as interacting steps, it is possible to achieve an especially safe and complete disentangling of the thread plug. The axial and/or radial pressures or forces placed on the last thread plug winding according to this invention are advantageously applied by carefully designed mechanical means and/or by pneumatic means, and more particularly by a separator near the exit end of the drum with means to place an axial advancing pressure and/or a radially directed pressure on at least a portion of the last thread plug winding to separate it from the next to last thread plug winding. These axial and/or radially directed pressures may act directly or indirectly on the emerging or disentangled thread which comes out of the last winding.

For providing an axial pressure, i.e. forces axially parallel to the drum axis, on the last thread plug winding in accordance with the invention, there is provided as one preferred embodiment, an axial advancing element having a spirally formed ring collar, the pitch of this collar approximating the angle of pitch of the last thread plug winding on the treatment drum. This ring collar device, which may have a crescent-like appearance, is well suited for separating the adjacently positioned and normally abutting windings of the stuffer-crimped or texturized thread plug material. Because of its extension over a part of the drum circumference and especially if constructed as a flat, spiral band, the separating element slides smoothly and effortlessly between the last two thread plug windings (as seen in the helical running direction of the thread plug). This precise insertion of the separator occurs without touching or damaging the drum surface. By further providing a rigidly held or fixed suspension of the separating element at a defined distance from the drum surface, the breakage or loss of individual filaments is completely avoided in a relatively simple manner. On the other hand, it is especially advantageous to provide a pivotal suspension of the separating element whereby it always tends to best adjust or accomodate itself to the pitch of the thread plug windings even when the ring collar or equivalent separator encircles only a small part of the drum circumference. This pivotal or swinging suspension is preferred when, for example, the texturizing is done with two or more threads and two or more thread plug windings are coiled in common and run adjacently to one another about the drum. In this case, it is not essential that the separator or axial advancing means be modified by a similar separating element with doubled or greater pitch, since the pivot-mounted separating element will automatically adjust itself obliquely to the drum axis.

With a pivoted or swinging suspension of the separating element, it is further desirable to position its pivot axis parallel to the axis of the treatment drum at a point above the treatment drum, and also to place the centroidal axis of this separating element as little as possible outside a vertical plane through the axis of the treatment drum. In this manner, the separating element can be positioned to lie upon the drum circumference with only a slight pressure or preferably to be suspended away from direct contact with the drum circumference, thereby avoiding undesired wear. In order to counteract any wear or damage to the contacting surfaces, the separating element is coated with an abrasion-proof plastic layer, e.g. an abrasion-resistant polymer coating or the like.

The separating element, as a rule, should extend through an angle of at least 90° over the drum circumference, especially more than 180°, for example over a preferred range of about 270° to 330°. The guidance of the separating element on the treatment drum is particularly improved with a spiral encirclement of more than half of the drum circumference, and the separating element is readily slipped or inserted between the thread plug windings to be separated. Here, too, a floating bearing or mounting of the separating element can be favorably realized, such that the separating element rests freely about the drum and is secured against turning by a simple stop means.

With the drum axis positioned vertically, the weight of the separating element when inserted as a crescent-like annular band or ring collar is sufficient to gently separate the last thread plug winding from the next to last thread plug winding. However, the band or collar separating element may also be in a fixed position around at least about 90° or more of the last winding and set at a pitch slightly greater than that formed by the preceding thread plug windings so that a corresponding slight deviation or advancing pressure is applied by this element to gradually separate the last winding. Even without such a weighted advance or a change in pitch, the mere insertion of a band or collar of a given thickness will serve to act as an advancing and separating means on the last winding, especially if accompanied by a coacting radial pressure to assist the disentangling process.

In order to apply axial forces by pneumatic means for separation of the last thread plug winding from the next to last thread plug winding, a preferred apparatus of the invention is one in which a stationary, cylindrical pot is fitted over the exit end of the drum and extends into the zone of the last thread plug winding with a mantle or casing which has an inside diameter pressed lightly in contact with the last winding. This substantially cylindrical mantle or casing of the pot has an outlet opening for the emerging disentangled thread or threads being drawn off from the drum.

Such a pot, with a lid closing off the exit end of the drum and with cylindrical side walls fitting over the last winding, forms with the last thread plug winding a throttle gap for air or another gas being sucked into the drum, thereby causing the flow of gas into the drum to be deflected in an axial direction. This air or gas stream is axially directed only against the last thread plug winding and separates not just this last winding but also especially the disentangled thread from the next to last winding. The rim of the pot defining its open end can extend up to the next to last thread plug winding so as to completely enclose the last winding; but this rim, as seen from the free end of the drum, can also terminate somewhat previously so that it axially covers preferably half but not all of the last winding. The generation of the axially directed air or gas stream is enhanced if the rim of the pot matches and is conformed to the pitch of the next to last thread plug winding.

The pot is placed with its closed end surface or lid fitting closely over the face surface at the exit end of the drum, so that no gas or only a limited amount of gas can be sucked in over the bottom side. On the other hand, it is advantageous for the mantle or circumferential walls of the pot to contain perforations so as to prevent too high an air flow from arising at the last thread plug winding and especially to prevent the disentangled thread from being sucked too far toward the drum end. These mantle perforations are preferably distributed such that the mantle air-permeability per surface unit is substantially less than the air-permeability per surface unit of the drum. This difference in air-permeability provides, on the one hand, a positive air stream axially directed toward the exit end of the cooling drum but also ensures, on the other hand, an air stream which cannot be so strong as to become harmful to the individual filaments.

As mentioned above, the exertion of a radial contact pressure or force on the thread plug to be disentangled can take place with mechanical and/or pneumatic means. A preferred device for the exertion of mechanical pressure is a fixed cage arranged about the circumference of the drum, preferably in the zone of the last thread plug winding, with a clear spacing or radial distance from the drum surface which decreases in the direction of rotational movement of the last thread plug winding. This cage can thus be arranged with respect to the drum on a spiral path becoming narrower in said direction of movement of the thread plug. Preferably, this cage extends over the drum circumference approximately to the tangential run-off point of the disentangled thread as it emerges from the drum. Moreover, this cage is advantageously combined with a separator exerting an axial pressure on the last winding.

A preferred embodiment of the cage consists of a plurality of pins of equal length and parallel to the drum axis, the pins being joined at their projecting end by a ring or spiral rail element. The above-mentioned ring collar can advantageously serve as the top or back rail of the cage to provide a separator which produces both axial and radial forces on the last winding. However, this cage may also be a smooth, perforated or even corrugated sheet metal plate that is bent or curved in a spiral form with respect to the drum. The cage may also be constructed as a circular annular mantle which is suspended in a fixed position with respect to the treatment drum, but which is arranged eccentrically in such a way that its distance from the drum surface is at first slightly greater than the diameter of a thread plug and then becomes progressively smaller in the helical direction of the winding toward the exit end of the drum.

With this preferred cage embodiment of the invention, it is possible to achieve a very uniform and controlled disentangling of the thread plug. The cage, which in no way impairs the gas-permeability of the treatment drum in the region of the last thread plug windings, does enhance the operating reliability of the apparatus in a special manner, since it effectively prevents the detachment and uncontrolled pulling off of relatively large fragments of the thread plug. Such fragments of the thread plug preferably dissolve by themselves with a reduced consistency or loosening of the thread plug as initially provided to increase the gas-permeability. However, the thread plug or plugs undergoing thermal gas treatment while wound on the drum must retain a certain coherency as a tangled and relatively tightly packed mass of crimped filaments, and without the cage, it has been impossible to avoid a frequent detachment of large fragments at the exit end of the drum.

In the breaking off or pulling away of such thread plug fragments, they receive the same high velocity at which the emerging thread is drawn off and spooled. These fragments, by reason of their high initial velocity, are thrown off tangentially to the drum circumference and drawn off almost intact with the emerging thread. The cage prevents this undesirable result by acting as a trapping device in which the fragments of the thread plug are intercepted and temporarily caught up so as to become completely disentangled. This final dissolution or disentanglement takes place in a relatively smooth and sensitive manner, especially if the cage narrows in the direction of movement of the thread plug so as to come closer and closer to the drum surface. In a still further preferred embodiment of the cage, the radial spacing of the cage pins from the drum, as viewed in the direction of rotational movement of the thread plug, is gradually reduced in the following manner:

in a first section, the pins are furthest from the drum so that the disentangling point can move freely inside this radial gap of the first section and automatically adjust itself; then, in a second section, the pins become closer to the drum surface so that fragments of the thread plug are trapped and gently dissolved; and under some circumstances, in a third section, the radial spacing of the pins from the drum surface is made so slight that only the emerging thread is still free to adjust its position.

The careful disentangling of the thread plug can also be promoted by the feature of exerting an increased radial flow of air or other gas on the last thread plug winding in the zone in which the thread plug is to be disentangled. Apparatus preferred according to the invention for the generation of this radial air flow comprises a screen member which extends as a curved segment at least over a part of the drum circumference and which also extends axially from the free end of the drum at least over the last thread plug winding, the screen being arranged before the zone in which the thread plug is to be disentangled. Preferably, such a screen member is also provided after the desired disentangling point of the last thread plug winding. These screens may be arranged either along the inner circumference of the drum or else along the outer circumference of the drum. In the latter case, the inside diameter of the screen or screens, as measured from the drum axis, is sufficient for the screens to conform closely to the last thread plug winding. The screens serve the purpose of reducing the air or gas flow conducted through the drum at the exit end of the drum and over a partial circumference of the last thread plug winding by a throttle effect in such a way that after the first-mentioned screen member covering the still tangled thread plug, or in the axial recess or opening between the two screen members, there arises a strengthened air flow. The thread plug after the first screen member or between the two screen members is thus pressed with increased contact pressure against the drum, thereby causing a disentangling of the thread plug in this zone.

In order to execute the combined axial and radial pressures for separating and disentangling the last thread plug winding, it is especially desirable to cover up the end of the drum by a separator comprising a substantially cylindrical pot having a mantle which extends up to the region of the next to last thread plug winding. This mantle has a low air-permeability, preferably lower than that of the drum. The pot is supported in a fixed position and provides a bottom surface or closed end cover at a defined close spacing to the free end or transverse facing surface of the drum, thereby restricting the flow of gas or air around the end of the drum. The mantle of this pot has an axial recess or cut-out which extends in the axial direction with a dimension substantially equal to the sum of the diameter of the thread plug winding to be disentangled, and in the circumferential direction with a dimension equal to a multiple of the thread plug diameter, e.g. up to approximately $\frac{1}{4}$ of the drum circumference.

The pot has a back rim defining its open end extending into the zone of the last thread plug winding, this rim preferably having a spiral configuration with an axial pitch which corresponds to the pitch of the last thread plug winding or is even greater. The mantle of the pot is thus adapted to provide the perforated screen members discussed above and, namely, in such a way that the air-permeability per surface area unit of the mantle is smaller than the air-permeability per surface area unit of the treatment drum.

The pot is also advantageously arranged in relation to the drum such that the radial distance of the mantle from the drum surface becomes smaller after the recess or cut-out segment. Moreover, the pot preferably has an axially directed narrow outlet slot for withdrawal of the disentangled thread. The pot can be formed spirally when viewing the mantle walls in a top plan view, i.e. from the open end of the pot. However, a pot of circular cross section is also useful when supported in a fixed position and arranged eccentrically to the drum. A preferred support for the pot is one in which it is freely or floatingly carried on the shaft of the treatment drum, preferably eccentrically to the drum axis, while being secured against turning by a stop element.

The pot is pressed axially toward the exit end of the drum by the prevailing differential pressure, preferably to rest against an axial stop so that there exists a predetermined narrow gap between the bottom of the pot and the face surface of the drum. A pot constructed and arranged in this manner exerts an increased radial and axial pneumatic pressure on the last thread plug winding in the zone of the desired disentangling point, i.e. in the region of the mantle recess where there is an increased gas flow. This pneumatic force is essentially directed both radially of the drum and axially parallel toward the free end of the drum. Through the intensified radial contact pressure of the thread plug on the drum in the mantle recess as well as through the removal of the last thread plug winding and, in particular, the concurrent removal of the disentangled thread from the next to last thread plug winding, the disentangling of the thread plug takes place primarily in the zone of the mantle recess, using easily regulated air flows.

By positioning the mantle after the recess to approach the drum surface with a narrowing radial gap, any thread plug fragments carried along by the thread from the disentangling zone are subjected to an additional, mechanically-applied radial force and are thereby completely disentangled. The size and shape of the perforations of the pot mantle can be varied to adjust the strength of the radial and axial forces exerted on the last thread plug winding and the emerging thread.

THE DRAWINGS

The invention is described in detail below with the aid of the accompanying drawings presenting preferred embodiments, wherein.

DESCRIPTION OF THE PREFERRED EMBODIMENTS

Figure 2:
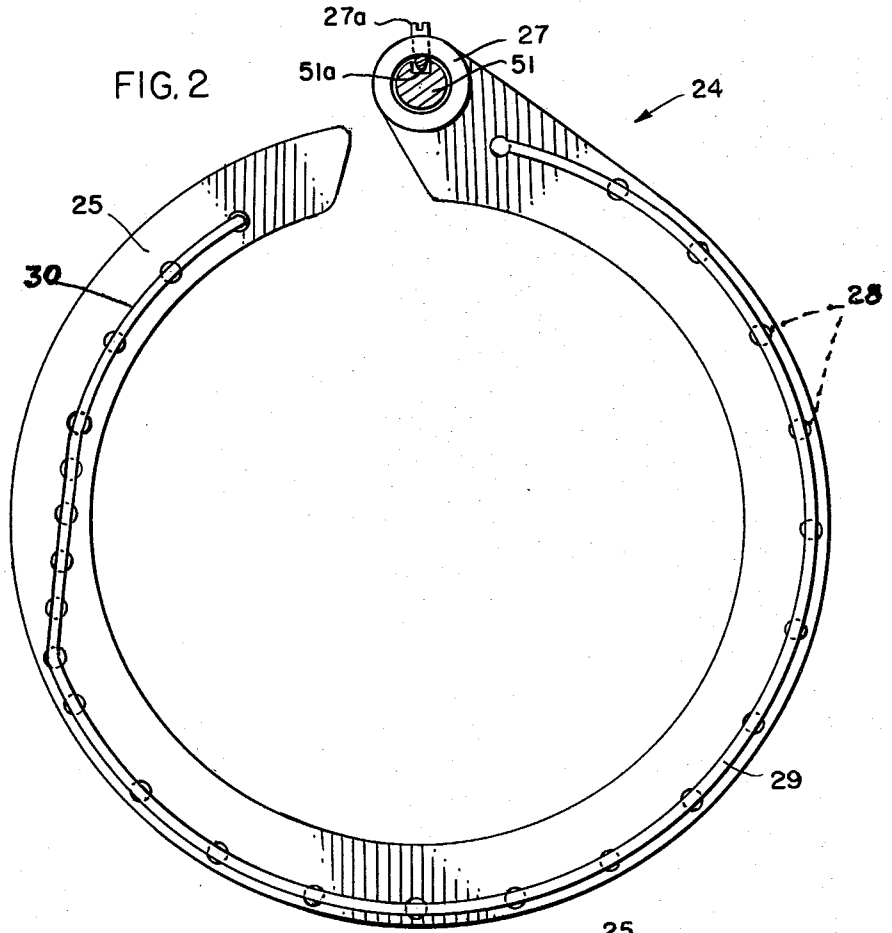
FIG. 2 is a front elevational view of one separating element according to the invention as shown when the drum of FIG. 1 is remounted into a horizontal position and is viewed from above.

The invention is further illustrated by the preferred embodiments shown in the drawings but the invention is not limited to these embodiments.

The individual filaments are melt-spun into a spinning shaft and combined into thread 1, e.g. as composed of a synthetic polymer, especially a polyamide such as nylon 6 or nylon 6,6 or a polyolefin such as polypropylene. The thread 1 is drawn off by a feed godet (not represented) and stretched as known between this feed godet and another draw godet operating at a higher speed. This spinning and stretching produce filaments having fiber properties capable of being crimped or texturized according to conventional methods. The thread 1 is then fed to a so-called blowing or discharge nozzle 2, operating on the principle of a jet ejector.

The discharge nozzle 2 has a feed line 4 heated by an electrical heating device 3 or the like so as to supply a propellant fluid, preferably air, steam or an inert gas heated to a predetermined temperature for stuffer crimping. The propellant fluid is distributed over the ring conduit 5 and released through the conical annular slot 6 into the thread channel 7 at a high velocity where it impinges on the thread 1. This hot jet stream plasticizes the thread and carries it along into the stuffer box 8, where the thread strikes against the already deposited thread material and is crimped and compressed into a compact thread plug 9. The propellant fluid can then escape through the openings or ports 10 in the wall of the stuffer box 8. The diameter or cross section of the thread plug 9 essentially corresponds to that of the stuffer box. All of these initial steps and apparatus used therein are well known in the stuffer crimping art.

In order to start the texturizing process, the lower end of the stuffer box 8 is closed by the slide gate 11 until all of the thread plug 9 is initially formed. The stuffer box 8 is then opened, and the thread plug 9 is conveyed continuously at its speed of growth and conducted to the driven transport rolls 12. These transport or conveying rolls 12 have a semicircular or rectangular recess on their circumference, so as to further form or shape the thread plug 9 as it is conveyed out of the stuffer box 8. The rolls 12 convey the thread plug 9 to the treatment drum 13 which is slowly rotated. These transport rolls 12 are not absolutely required but they are used to accomplish a preferred execution of the texturizing apparatus, especially so as to achieve constant operating conditions through a positive and well-controlled conveyance of the thread plug 9.

The thread plug 9 is conducted tangentially onto the treatment drum 13. For this purpose, as represented in the drawings, a deflecting guide plate 14 may be provided between the emergence gap of the transport rolls 12 and the treatment drum 13. By such a deflection means, it is also possible, for example, to loosen the consistency of the thread plug 9 and substantially increase is gas-permeability.

The thread plug 9, which may have a circular or other cross section as imparted by the recess on the circumference of the transport rolls 12, is helically wound onto the rotationally driven treatment drum 13. A first advancing device is provided by the circular plate 15, which is arranged in a fixed position and surrounds the treatment drum 13 over at least part of its circumference. This plate 15 is arranged at a pitch angle which imposes on the deposited thread plug winding 9.1 a component of movement in the axial direction of the treatment drum 13, so that the thread plug winding is moved in part in a rotating helical path and in part axially downwardly toward the exit end of the drum, thereby forming dense winding layers 9.1 adjacent to one another over the treatment drum.

Figure 1:
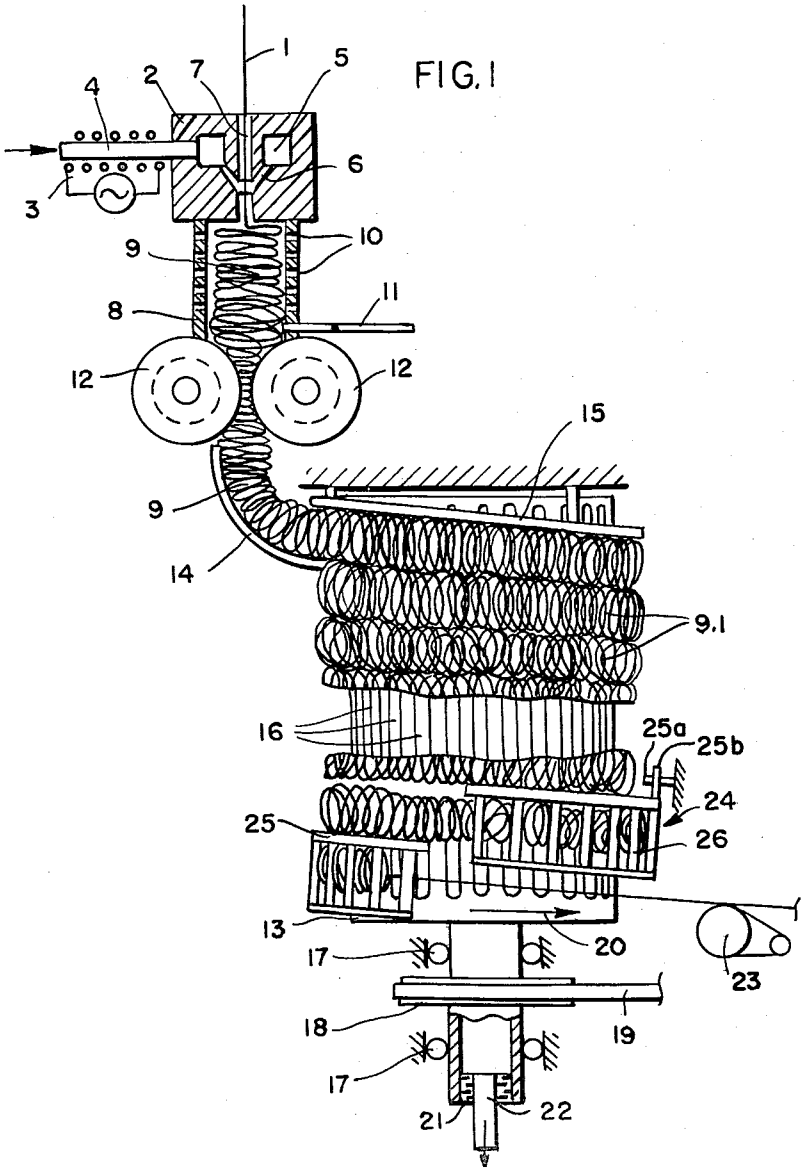
FIG. 1 is a partly schematic, side elevational view with some parts in cross section, illustrating suitable apparatus for stuffer crimping and thermal treatment on a drum with a separating element of the invention, located at the exit end of the drum.

The treatment drum 13 has openings 16, e.g. elongated slots or perforations, distributed over its length from the entry end to the exit end. In FIG. 1, some windings of the thread plug 9 are omitted to better view the openings 16. Referring further to FIG. 1, the shaft of the treatment drum 13 is journalled in the ball bearings 17 and is rotatably driven over a belt pulley 18 by means of a tangential belt 19, thereby turning the drum in the direction of the arrow 20. The speed of rotation of the treatment drum can be adjusted, e.g. so as to be attuned to the growth rate of the thread plug 9 and the disentangling rate of the thread at the drum exit end. A speed-controllable drive motor (not represented) or similar speed-adjusting means is set to provide a steady state operation wherein the disentangling point of the thread plug 9 remains approximately at the established position and does not move along the drum circumference. The drive shaft of the treatment drum 13 is connected over a packing gland or labyrinth 21 to the fixed suction pipe 22 of a conventional air suction line. In the operation of this crimping or texturizing apparatus, a subatmospheric pressure (partial vacuum) is generated in the hollow drum 13. Through this partial vacuum, ambient air is sucked through the closely packed, adjacent layers of the thread plug windings 9.1 as wound in a helical pattern on the treatment drum 13. The air at room temperature sufficiently cools the thread so that the crimping introduced in the stuffer box 8 is set or fixed before the continuous thread plug 9 is disentangled at the drum exit end. The resulting permanently texturized thread is drawn off the drum by the draw-off device 23.

Figure 4:
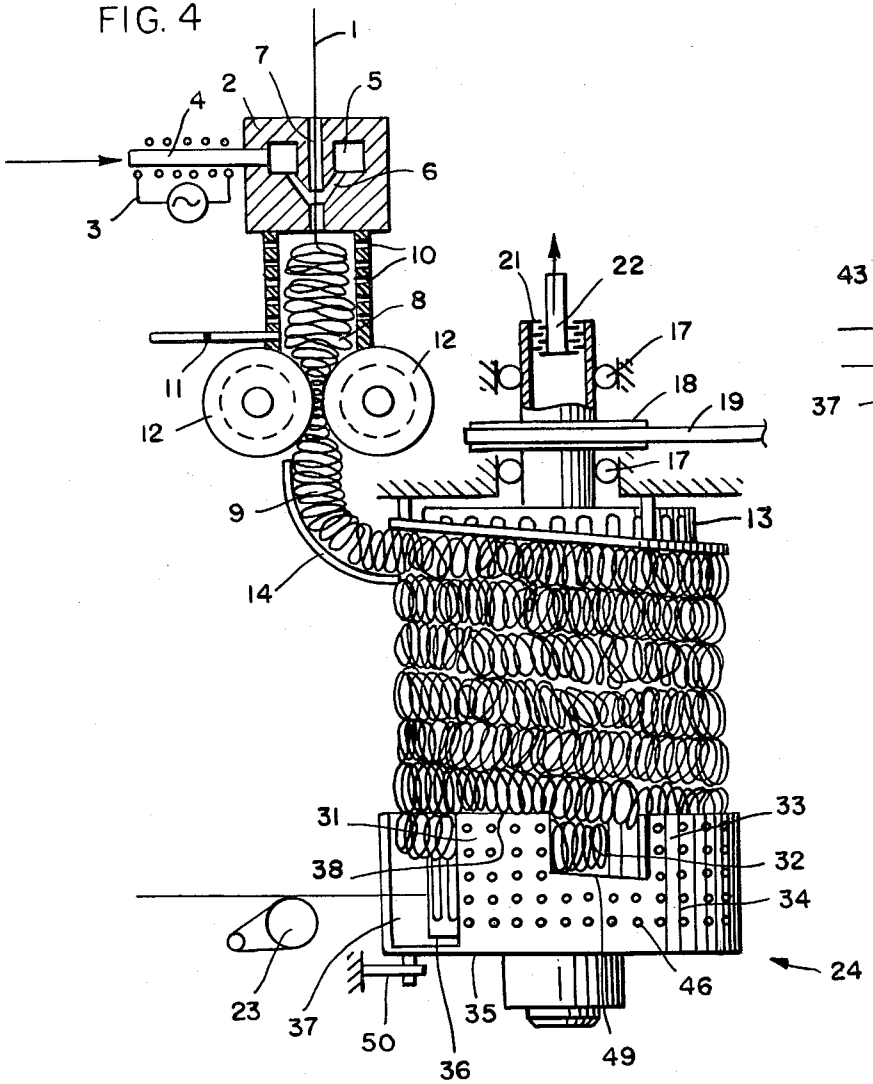
FIG. 4 is a view similar to FIG. 1 but showing another embodiment of a separator mounted at the exit end of the drum.

At the exit end of the drum, as generally pointed out in each of FIGS. 1 and 4, there is arranged the thread draw-off accessory or separator 24 as required by the present invention whereby the last winding of the thread plug is separated from the preceding windings pushed tightly together by the first advancing device 15. The thread draw-off accessory 24 is generally formed as a circular or ring-shaped separating element which at least partly surrounds the circumference of the treatment drum 13, for example as a crescent-shaped, spirally running ring collar 25 (FIG. 1) or as an assembly of screen members in a cylindrical pot 34 fitting over the drum end 36 (FIG. 4).

In FIG. 1, an especially preferred separating element is illustrated in the form of a ring collar 25 which surrounds the treatment drum 13 over approximately the entire drum circumference and has an open cage 26 attached thereto and projecting outwardly toward the free exit end of the drum, i.e. where the drum is remounted so that its axis of rotation projects horizontally from a vertical face of the machine frame.

Figure 3:
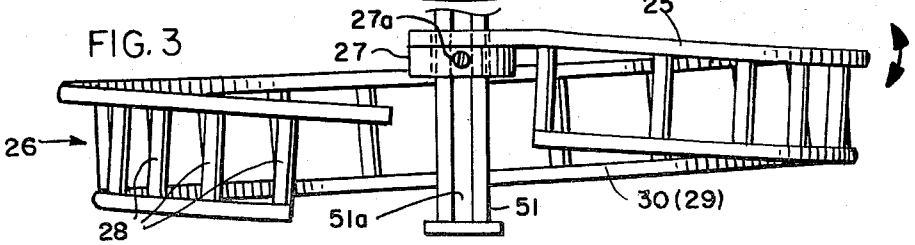
FIG. 3 is a top plan view of the separating element of FIG. 2.

In FIGS. 2 and 3, this preferred separator 24 is shown in detail. Here the ring collar 25 with its attached cage 26 is mounted on the drum by means of the bearing eye or support lug 27, whereby the separator is carried axially slidable and preferably pivoted to swing on an axis parallel to and above the drum axis (with the drum seen as in a top plan view in FIG. 1). A simple mounting stud or shaft 51, as shown in cross-section in the front elevation of FIG. 2 and also as shown from above in the top plan view of FIG. 3, framework of the apparatus to extend axially parallel to the drum axis through the eye of lug 27, a tightening screw or stop pin **27*a* being insertable into this mounting stud through the bore in the support lug if it is desired to fix the ring collar in a set position relative to the drum. If the ring collar 25 rests freely so as to "float" on the last winding as shown in FIG. 1, additional stop means or restraining means 25*a*, 25*b* can be readily added to prevent the ring collar 25 and its cage 26** from rotating with the drum. These and other mounting variations for the ring collar and cage can be adopted to provide essentially equivalent results for the axial advancement and separation of the last thread plug winding from the next to last winding.

In order to prevent abrasion and damaging wear of the separating element on the treatment drum 13, the centroidal axis of the separating element should preferably lie in a vertical plane which also passes through the drum axis. In order to more easily fulfill this desirable but not essential requirement, it is advantageous to execute the separating element with a relatively large encirclement of the treatment drum 13, for example up to about 330°. It is also favorable to coat the separating element with an abrasion-proof polymer layer, for example, with polytetrafluoroethylene (Teflon). Individual parts of the ring collar 25 and/or the cage 26 may also be made of an abrasion-resistant and non-wearing polymer such as nylon.

The cage 26 consists of a number of bars or rods of equal length, each being oriented parallel to the drum axis, for example the cylindrical pins 28 which are arranged along two circular sections 29 and 30 concentric to the drum axis with an intermediately positioned transition zone as shown by the spiral rail 29,30 in FIG. 2. The cage 26 is terminated as shown in FIG. 3 at its lower projecting end by the arcuate element or rail 30(29) which also serves to connect the free ends of the pins 28 with one another. Thereby, the threads or filaments are prevented from catching in the pins during application of the cage to the last winding. Also, the hazard of injury to operating personnel is substantially reduced.

Through the arrangement of the cage pins at predetermined spaced intervals, suddenly freed fragments or portions of the thread plug 9 are prevented from being thrown off at high velocity away from the drum surface. On the contrary, such loose fragments are caught and trapped or pressed between the drum surface and the cage bars until each fragment of the thread plug 9 is completely disentangled.

Figure 5:
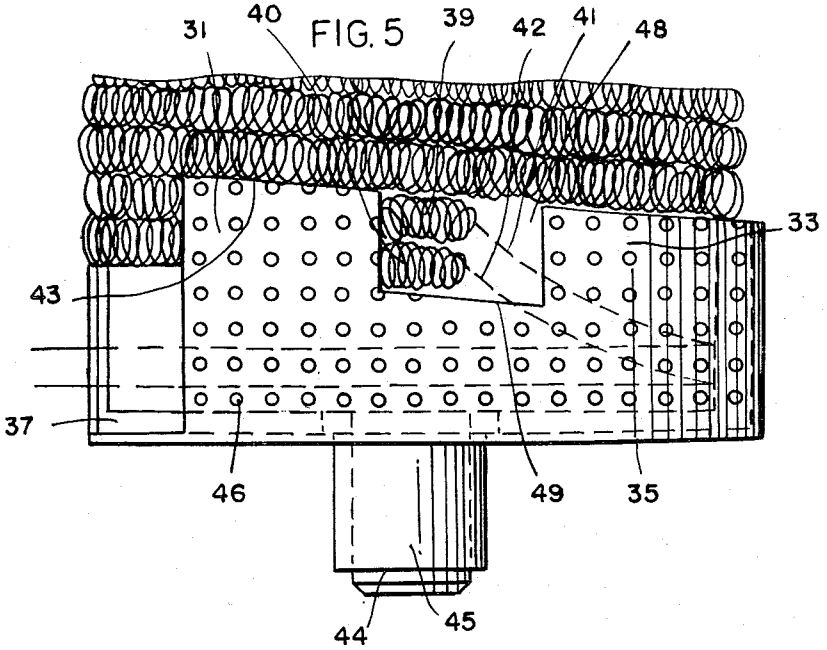
FIG. 5 is a further partial side view of the exit end of the treatment drum with the separator acting on paired thread plugs.
Figure 6:
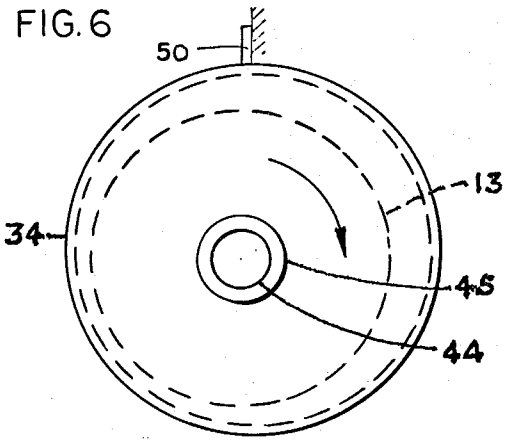
FIG. 6 is a partly schematic bottom plan view of the separator of FIGS. 4 and 5 to illustrate a preferred eccentric mounting over the drum.

In FIGS. 4 and 5 and the corresponding schematic end view according to FIG. 6, there is illustrated another preferred thread draw-off accessory 24 which exerts essentially pneumatic forces on the last thread plug winding. Here again, the treatment drum 13 is shown with the thread plug windings helically wound thereon, but with its vertical rotatably driven shaft being mounted overhead in the bearings 17 for operation by mens of the pulley 18 and belt drive 19. The initial crimping of the thread 1 in the stuffer box 8 and its feed onto the drum surface with axial advancement by the inclined plate 15 are all carried out in substantially the same manner as shown in FIG. 1 so that reference is made to the preceding description for this portion of the apparatus as well as to the similar description given in U.S. Pat. No. 4,118,843 which further offers a number of useful alternative arrangements in the treatment of two or more commonly treated thread plugs.

Over the thread draw-off end of the treatment drum, there is fitted as shown in FIG. 4 a stationary cylindrical pot 34 with its bottom surface or cover 35 arranged close to the free end surface 36 of the drum 13. The inner diameter of the pot corresponds substantially to the diameter of the drum with a closed thread plug winding lying on the drum surface, i.e. so that the inner wall surfaces of the pot come in light moving contact with the windings. The pot has an axially directed thread exit opening or slot 37 through which the thread is drawn off by means of a godet or similar draw-off mechanism 23. Immediately following the axial slot 37, the screen member or section 31 is arranged as part of the wall structure of the pot. This first screen 31 is followed by a recessed opening 48 and this in turn is followed by a second screen member 33. Between the screens 31 and 33, i.e. in the opening 48, there is located the desired thread disentangling point 32. The two screens extend axially essentially to cover the last thread plug winding (FIG. 4) or the last pair of windings (FIG. 5). The rear edge 49 of the opening is preferably arranged at about the front edge of the last thread plug winding or paired plug windings 39,40. The pot mantle 34 has perforations 46, the air-permeability of which is substantially less than the air-permeability of the treatment drum. The second screen section 33 extends around the drum 13 to the thread exit slot 37. It should be mentioned that the thread or paired threads 41,42 run over the drum surface through an angle of more than 90°, preferably more than 180°, from the disentangling point 32 to the take-off from the treatment drum through exit slot 37. This extended path of the emerging threads within the pot offers a longer acting axial pressure on these threads with a certain air flow to assist the final disentangling of the threads.

The screen 31 and the screen 33 cause an especially high air flow in the opening or recess 48 between these screens, this increased air flow being directed radially upon the treatment drum surface. Simultaneously, however, air is also drawn over the entire rim of the separating pot, i.e. over the rear edges of the screens 31 and 33 as well as over the rim or edge 49 of the opening 48, the air flowing in an axially parallel direction from these edges under the pot mantle. In this way, the air stream inside the pot and along the drum surface acquires a very strong axial component. In the disentangling process, this combined air flow results in the thread plug being pressed very strongly onto the drum surface with both the last thread plug winding and the disentangled thread also being blown in the direction of the free end of the treatment drum. The spacing between the bottom surface 35 of the draw-off pot and the face surface 36 of the cooling drum as well as the size of the perforations 46 and the width of the axial thread draw-off slot 37 are selected in such a way that the radial and axial components of the air stream prevailing in the opening 48 and under the mantle are sufficiently strong to fix the disentangling point of the thread plug or plugs in the zone of the opening 48. With the pot separator of the invention, air flow components can be maintained for a clean separation of the last thread plug winding(s) and in particular of the disentangled thread(s) from the next to last thread plug winding.

On the other hand, the air flow components are sufficiently mild and controlled to prevent the last thread plug winding and particularly the disentangled thread(s) from being drawn down to the face surface 36 of the treatment drum 13, since this would cause a serious disturbance of the draw-off operation.

In FIG. 5, there is illustrated a modified example of the pot separator. Here, two threads are simultaneously treated as they are wound into two adjacent helical thread plug windings 39 and 40 on the treatment drum 13. These two thread plugs are disentangled after the drum treatment, beginning in the zone of the opening 38 between the screens 31 and 33, so as to separate the two threads 41,42. The rim of the pot, i.e. the front edge of screens 31 and 33 has its pitch matched to the pitch of the next to last pair of thread plug windings such that the screens extend up to this next to last pair of thread plug windings. The axial dimension of the opening 48 between the screens 31 and 33 is thus preferably selected as the sum of the diameters of the thread plugs 39,40 being treated, so that the leading edge 49 of the opening 48 reaches up to border the last thread plug winding. Through the feature that the rear edge or rim of the screens 31,33 is conformed to the pitch of the next to last thread plug winding, the action of the axially directed air flow component is further improved in providing a precise separation along this pitch line. The pot in FIG. 5 is mounted by means of a journal bearing or bushing 45 on the free shaft end 44 of the treatment drum. By means of stop 50 as shown in FIGS. 4 and 6, the separator pot is prevented from turning along with the drum shaft.

The pot as shown in FIGS. 5 and 6 is borne eccentrically on the shaft 44 by means of its journal bearing or bushing 45, so that the clear spacing or gap between the drum surface and the inner wall of the screen mantle 33 becomes narrower and narrower as this gap approaches the thread exit slot 37.

The operation of the separator pot may be described as follows in conjunction with FIGS. 4–6. Because the free end of the treatment drum 13 is substantially covered by the pot mantle screens 31 and 33, a relatively strong axial air flow is generated over the rear edges of the screens 31 and 33, which have a pitch preferably on a line with the front pitch of the next to last pair of thread plug windings, this axial air flow being drawn under the mantle or circumferential walls of the pot. In the zone of the opening 48 a strong radial air flow is produced so as to press the thread plugs 39 and 40 onto the drum surface. Over the leading edge 49 of the opening 48, however, an air flow component becomes directed axially under the pot wall so that the initially disentangled threads 41,42 (schematically represented here as completely separated) are drawn and blown in an axial direction toward the free end of the drum. If these measures do not suffice for the complete disentangling of the thread plugs 39 and 40 in the zone of the opening 48, i.e. such that thread plug fragments stray under the screen 33 as well, then these fragments are quickly disentangled by the reduced clearance of the screen 33 with respect to the drum surface. This gap or clearance is diminished to such a degree that the thread plug fragments dragged along by the emerging thread are subjected to a greater radial pressure with an increasing friction in the circumferential direction, and the fragments are easily disentangled by a relatively light friction.

It should be noted that the present invention as described herein is concerned with a treatment drum where it is possible to provide a parallel treatment of a number of stuffer box crimped threads. In this case, thread plugs are formed of the parallel threads which are run adjacently together on the drum as represented, for example, in FIG. 5 for the two threads 41,42 and their two thread plugs 39,40. Accordingly, within the scope of this application and its claims, a mention of a thread plug winding is always intended to include one or more thread plug windings running adjacent to one another to correspond to the number of parallel threads treated in common on the drum. Likewise, any reference to the "last winding" or the "next to last winding" includes two or more thread plugs commonly treated in each such winding. The reference to a "thread" herein is intended to include yarns, tows or the like composed of continuous synthetic thermoplastic filaments as are frequently texturized by the known stuffer box crimping apparatus. The "treatment drum" used in the present invention is substantially cylindrical but may also be slightly tapered as suggested in U.S. Pat. No. 4,118,843 to accommodate a certain amount of relaxation or shrinkage, depending on the particular threads being treated.

A number of variations in the process and apparatus of this invention are thus easily adopted and handled by the present improvement in the separating and disentanglement of the texturizing thread plug windings using the above-described special separators.

We claim:

1. In a process for the thermal treatment of at least one continuously running thread plug as formed from a thread of synthetic filaments in a stuffer crimping box, said thread plug being circumferentially conducted and wound into a closed layer of a plurality of helically coiled windings on a rotationally driven, air-permeable treatment drum, said thread plug also being advanced from the entry end to the exit end of said drum by a device applying pressure in the axial direction of the drum to a first winding at the entry end of said drum, and withdrawing the thread after thermal treatment on said drum at a disentangling point near the exit end of the drum, the improvement which comprises:

applying an additional advancing pressure in the axial direction of the drum onto only a last portion of said thread plug winding layer running into said disentangling point, said additional pressure being greater than said pressure applied in the axial direction to said first winding so as to axially separate said last portion of the thread plug winding and said thread away from the preceding thread plug winding and toward the exit end of the drum.

2. A process as claimed in claim 1 wherein an increased pressure directed radially of said drum is applied to at least one point of at least one portion of the last thread plug winding in its path leading up to and after said disentangling point.

3. A process as claimed in claim 1 wherein a smooth contacting surface is inserted between at least a portion of the last thread plug winding and the preceding thread plug winding at a pitch angle with reference to the drum axis sufficient to mechanically separate the last thread plug winding away from the preceding winding toward the drum exit.

4. A process as claimed in claim 1 wherein air flow is directed at the exit end of said drum to apply a pneumatic pressure radially of the drum against the last thread plug winding at said disentangling point and to apply an axial pneumatic pressure against at least a portion of the last thread plug winding and said thread emerging from the disentangling point, in the direction of the drum exit end.

5. A process as claimed in claim 1 wherein the last thread plug winding is passed through an annular passageway formed between the drum and a surrounding wall surface, said passageway being gradually reduced in its radial width following said disentangling point in order to place a disentangling contact pressure on the thread plug.

6. In apparatus for the thermal treatment of at least one continuous stuffer-crimped thread plug including at least a stuffer crimping box, a rotationally driven treatment drum of substantially cylindrical configuration and adapted to receive at least said thread plug coiled circumferentially thereon in a closed layer of a plurality of helical windings, said drum having a large number of openings in its cylindrical surface which contacts the thread plug windings, means to transport said thread plug from said stuffer crimping box onto the entry end of said drum, means at the entry end of said drum to advance the closed layer of helical windings axially of the drum toward the exit end of said drum, means to induce a gas flow through the drum openings for treatment of the thread plug, and means to draw off the thread from the last thread plug winding at a disentangling zone near the exit end of said drum, the improvement in combination with said apparatus which comprises:

a separator near the exit end of said drum with means to place an additional advancing pressure in the axial direction of the drum onto only a last portion of the thread plug winding layer to axially separate the last thread plug winding away from the preceding thread plug winding and toward the exit end of the drum.

7. Apparatus as claimed in claim 6 wherein said separator is an axial advancing element having a helically formed ring collar extending in the direction of rotation of the drum over at least part of the drum circumference, the pitch of said collar approximating the angle of pitch of the last thread plug winding.

8. Apparatus as claimed in claim 7 wherein said ring collar is spaced radially outwardly from the drum and supported such that it does not contact the drum circumference.

9. Apparatus as claimed in claim 8 wherein said ring collar is mounted to pivot about an axis parallel to the drum axis, said collar being axially slidable along said parallel axis and mounted for slight tilting about an axis perpendicular to said parallel axis.

10. Apparatus as claimed in claim 8 wherein said ring collar is supported for sliding movement along an axis parallel to the drum axis of rotation and encircles a portion of the drum circumference at a radial distance therefrom of less than about half the thread plug diameter.

11. Apparatus as claimed in claim 10 wherein said ring collar is a flat, helical band for insertion between the last thread plug winding and the next to last thread plug winding.

12. Apparatus as claimed in claim 10 wherein said ring collar is mounted to float freely about said drum while being supported on the last thread plug winding, with stop means to prevent said collar from rotating together with the drum.

13. Apparatus as claimed in claim 6 wherein said separator is made of an abrasion-resistant plastic in at least those surfaces of said separator coming into contact with the drum, the thread plug winding and the emerging thread.

14. Apparatus as claimed in claim 6 wherein said separator encircles the drum over at least about 90° of its circumference.

15. Apparatus as claimed in claim 6 wherein said separator encircles the drum over an angle between about 180° and 330° of its circumference.

16. Apparatus as claimed in claim 6 wherein said separator comprises a stationary cylindrical pot fitting over the exit end of said drum and extending into the zone of the last thread plug winding to provide a mantle extending circumferentially around said drum with an inner diameter sufficiently small to permit at least partial surface contact of the pot with said last thread plug winding, and said pot having an outlet opening for the emerging thread being drawn off.

17. Apparatus as claimed in claim 16 wherein the back rim of said pot defining the open end thereof extending into the zone of the last thread plug winding is helically adapted to the pitch of said last thread plug winding.

18. Apparatus as claimed in claim 16 wherein said pot is perforated to provide an air-permeability which is less than the air-permeability of the drum per unit of surface area.

19. Apparatus as claimed in claim 6 wherein a stationary cage is arranged about the circumference of said drum in the zone of at least the last thread plug winding and at a radial distance from the drum surface which decreases in the direction of rotational movement of said last winding.

20. Apparatus as claimed in claim 19 wherein said cage extends around the drum circumference up to about the point at which the disentangled thread is drawn-off tangentially from the drum.

21. Apparatus as claimed in claim 6 wherein said separator includes a stationary screen member arranged before the disentangling zone to extend over at least a portion of the drum circumference and to extend axially at least from the free end of the drum into the region of the last thread plug winding.

22. Apparatus as claimed in claim 6 wherein said separator includes a stationary screen member arranged after the disentangling zone to extend over at least a portion of the drum circumference and to extend axially from the free end of the drum at least onto the last thread plug winding.

23. Apparatus as claimed in claim 21 or 22 wherein the screen member is arranged along the outer circumferential surface of the drum to conform closely to at least the last thread plug winding.

24. Apparatus as claimed in claim 6 wherein said separator comprises a stationary cylindrical pot of lower air-permeability than that of the drum, said pot being arranged with its closed end covering and fitting closely over the free end of the drum and with its circumferential mantle extending up to the region of the next-to-last thread plug winding, said mantle having one axial opening as an outlet for the emerging thread being drawn off and said mantle having another axial opening in the form of a recess in its rim which covers at least the last thread plug winding, the axial dimension of said recess corresponding approximately to the total diameter of the thread plug windings covered by the mantle and the circumferential dimension of said recess corresponding to a multiple of the thread plug diameter.

25. Apparatus as claimed in claim 24 wherein the rim of said mantle has a pitch corresponding to the angle of pitch of the next to last thread plug winding.

26. Apparatus as claimed in claim 24 wherein said recess is positioned at the disentangling zone of at least the last thread plug winding to provide a radial pneumatic pressure at this point which is accompanied by an axial pneumatic pressure on either side of this point as applied to at least said last thread plug winding.

27. Apparatus as claimed in claim 24 wherein said pot is mounted eccentrically about said drum.

* * * * *